US012004609B2

(12) United States Patent
Bonfante

(10) Patent No.: US 12,004,609 B2
(45) Date of Patent: Jun. 11, 2024

(54) COMPONENT AND METHOD FOR ASSEMBLING A JEWELRY ITEM

(71) Applicant: Vincenzo Bonfante, Valenza (IT)

(72) Inventor: Vincenzo Bonfante, Valenza (IT)

( * ) Notice: Subject to any disclaimer, the term of this patent is extended or adjusted under 35 U.S.C. 154(b) by 867 days.

(21) Appl. No.: 17/042,278

(22) PCT Filed: Mar. 27, 2019

(86) PCT No.: PCT/IB2019/052493
§ 371 (c)(1),
(2) Date: Sep. 28, 2020

(87) PCT Pub. No.: WO2019/186423
PCT Pub. Date: Oct. 3, 2019

(65) Prior Publication Data

US 2021/0015219 A1 Jan. 21, 2021

(30) Foreign Application Priority Data

Mar. 30, 2018 (IT) ..... 102018000004147
May 15, 2018 (IT) ..... 202018000002553

(51) Int. Cl.
*A44C 5/10* (2006.01)
*A44C 11/00* (2006.01)

(52) U.S. Cl.
CPC ..... *A44C 5/102* (2013.01); *A44C 11/007* (2013.01)

(58) Field of Classification Search
CPC ..... Y10T 29/49591; Y10T 29/49597; F16G 15/12; F16G 15/00; F16G 15/04;
(Continued)

(56) References Cited

U.S. PATENT DOCUMENTS 1,210,624 A * 1/1917 Fishel ..... A44C 11/00 59/80
1,403,600 A * 1/1922 Grand ..... A44C 11/007 63/11

(Continued)

FOREIGN PATENT DOCUMENTS

EP 0499189 A1 8/1992
EP 2789253 A1 10/2014

(Continued)

*Primary Examiner* — Jack W Lavinder
(74) *Attorney, Agent, or Firm* — Dickinson Wright PLLC; Andrew D. Dorisio

(57) ABSTRACT

A link component for a jewellery item includes a hollow body with substantially opposed, spaced side surfaces, one or more junction elements connecting the side surfaces, at least one connecting arm projecting outwardly from one side surface, and a through opening on the opposed side surface. The connecting arm of one link component is designed to be inserted into a corresponding through opening of an adjacent link component. At least one pin with a substantially polyhedral shape and dimensioned smaller than the overall dimensions of such connecting arm is provided on one of the side surfaces, and a corresponding connecting through hole having shape and dimensions substantially equal to those of the pin is on the opposed side surface. The pin of a link component is inserted into a corresponding connecting through hole of an adjacent link component, to prevent relative rotation around the axis of the pin.

17 Claims, 16 Drawing Sheets

(58) Field of Classification Search
CPC ..... F16G 15/02; A44C 11/007; A44C 11/00; A44C 5/02; A44C 17/0208; A44C 17/0216; A44C 17/0225; A44C 17/0233; A44C 5/00; A44C 11/002; A44C 15/005; A44C 15/0055; A44C 17/02; A44C 17/107; A44C 5/102; A44C 13/00; A44C 5/107
See application file for complete search history.

(56) References Cited

U.S. PATENT DOCUMENTS

| | | | | | |
|---|---|---|---|---|---|
| 1,410,366 | A * | 3/1922 | Buchman | A44C 11/007 | 59/80 |
| 3,673,794 | A * | 7/1972 | I'Anson | F16G 13/07 | 59/8 |
| D317,139 | S * | 5/1991 | Chia | D11/93 | |
| 8,156,759 | B2 * | 4/2012 | Nevatia | A44C 5/102 | 63/3 |
| 10,271,619 | B1 * | 4/2019 | Peck | A44C 9/02 | |
| D873,703 | S * | 1/2020 | Borsari | D11/86 | |
| D873,704 | S * | 1/2020 | Borsari | D11/86 | |
| 10,537,160 | B1 * | 1/2020 | Busiashvili | A44C 5/102 | |
| 2007/0044511 | A1 * | 3/2007 | Marco | A44C 5/022 | 63/38 |

FOREIGN PATENT DOCUMENTS

| | | | |
|---|---|---|---|
| WO | 2011086514 | A2 | 7/2011 |
| WO | 2016059655 | A1 | 4/2016 |
| WO | WO-2020036240 | A1 * | 2/2020 |

* cited by examiner

COMPONENT AND METHOD FOR ASSEMBLING A JEWELRY ITEM

FIELD OF THE INVENTION

The present invention is in general related to a jewelery item and, in particular, to a component and a method for manufacturing a jewelery item featuring a chain-link structure, such as, for example, a necklace or a so-called "tennis" bracelet.

BACKGROUND

As is known, a "tennis" bracelet is composed by a continuous series of signet or link components, which link to each other to form a flexible structure featuring a longitudinal development. A similar chain-link structure can also be used to implement jewelery items different from a bracelet such as, for example, a necklace or an anklet. In order to form said chain-link structure, each signet or link component is provided with a respective coupling element for coupling with an adjacent signet or link component. This coupling element might be comprised of, for example, a properly shaped connecting arm.

Upon assembling a jewelery item, the operator subsequently links the individual signet or link components sequentially, through a number of specific operations performed on the coupling element of each signet or link component. These operations usually consist of introducing a coupling element of a given signet or link component into a corresponding coupling portion of an adjacent signet or link component, properly folding such coupling element, and subsequently welding such coupling element on a certain surface of the adjacent signet or link component.

Irrespective of the type of jewelery item manufactured according to said technique, such jewelery item shall in any case make it possible for the individual links to angularly move one with respect to the other. In this way, the jewelery item can result sufficiently flexible to fit a specific anatomical part of a user, such as, for example, his/her respective wrist.

At least a part of the signet or link components of a jewelery item might also be provided with respective decorative stones, such as, for example, precious or semi-precious stones. In this configuration, it is essential that the signet or link components of the jewelery item do not undergo relative twists around the longitudinal axis of the jewelery item itself. Otherwise, some signet or link components might undergo such offsets as to at least partially conceal the decorative stones when the jewelery item is worn. In addition to that, any offsets of the signet or link components might weaken the reciprocal connection of the signet or link components themselves and cause the jewelery item to get broken over time.

For example, WO 2011/086514 A2 discloses a jewelery item featuring a chain-link structure wherein each link is provided with two connecting arms parallel to each other on a respective side surface and with two corresponding through openings on the opposite side surface to receive the connecting arms of an adjacent link. However, the dimensions of the through openings are considerably greater than the cross-sectional dimensions of the connecting arms. Whereas this feature assists the linking operations, on the other hand it does not prevent the relative twists that might occur between the links around the longitudinal axis of the jewelery item. Conversely, EP 2789253 A1 discloses a jewelery item featuring a chain-link structure wherein the connecting arms of each link insert into grooved portions (instead of through openings) of an adjacent link. Then the connecting arms undergo a subsequent folding to make it possible to link the structure of the jewelery item.

SUMMARY

An object of the present invention is therefore to provide a jewelery item, in particular a component and a method for manufacturing a jewelery item featuring a chain-link structure, that is capable of solving the above-mentioned drawbacks of the known art in and extremely simple, cost-effective, and particularly functional manner.

In details, an object of the present invention is to implement a jewelery item featuring a chain-link structure that is capable of preventing, or at least minimizing, the reciprocal twist of its respective signet or link components.

Another object of the present invention is to implement a jewelery item featuring a chain-link structure that is capable of making the reciprocal connection between adjacent signet or link components more stable and lasting as compared to similar jewelery items according the prior art.

These objects according to the present invention are achieved by implementing a jewelery item featuring a chain-link structure, a respective link, and a respective manufacturing method as set forth in the independent claims.

Further features of the invention are highlighted in the dependent claims, which are an integral part of the present disclosure.

BRIEF DESCRIPTION OF THE DRAWING FIGURES

The features and advantages of a jewelery item featuring a chain-link structure according to the present invention will be more apparent from the following description, which is an explanatory non-limitative one and makes reference to the attached schematic drawings, wherein.

DETAILED DESCRIPTION

Figure 13:
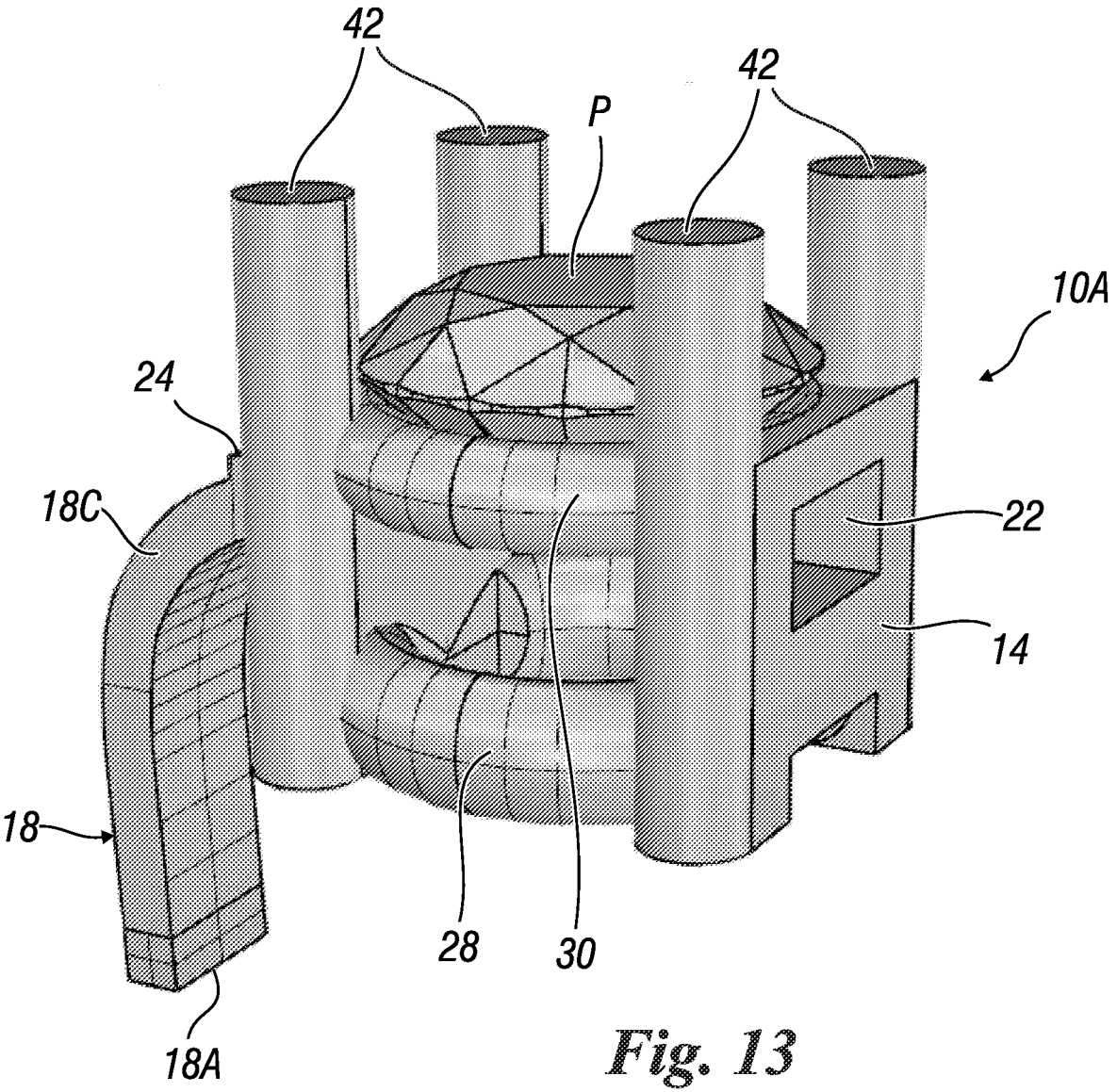
FIGS. 13 and 14 show a first embodiment of the link component illustrated in FIG. 9, in a perspective view and in a side view respectively.
Figure 14:
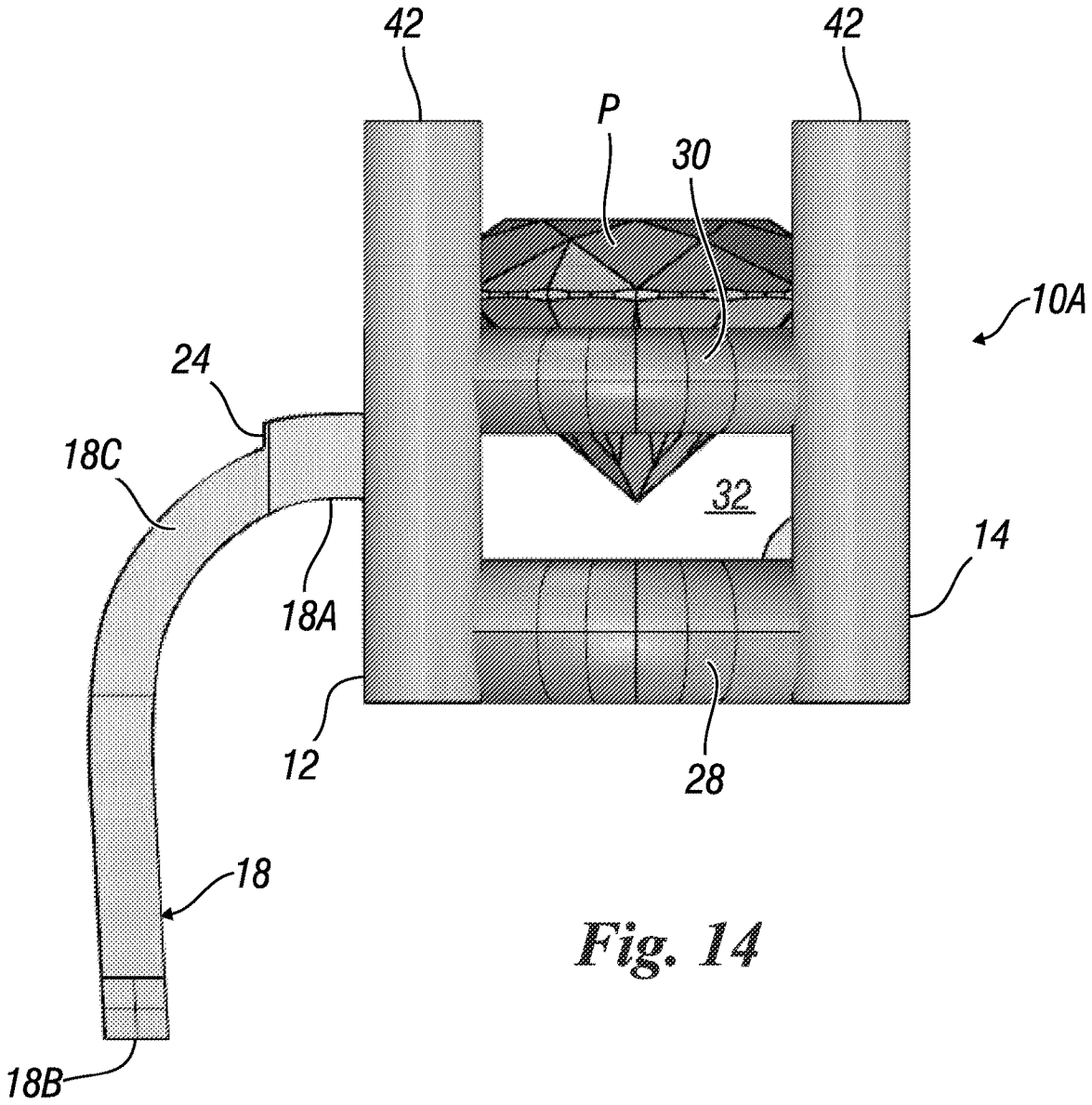
Figure 15:
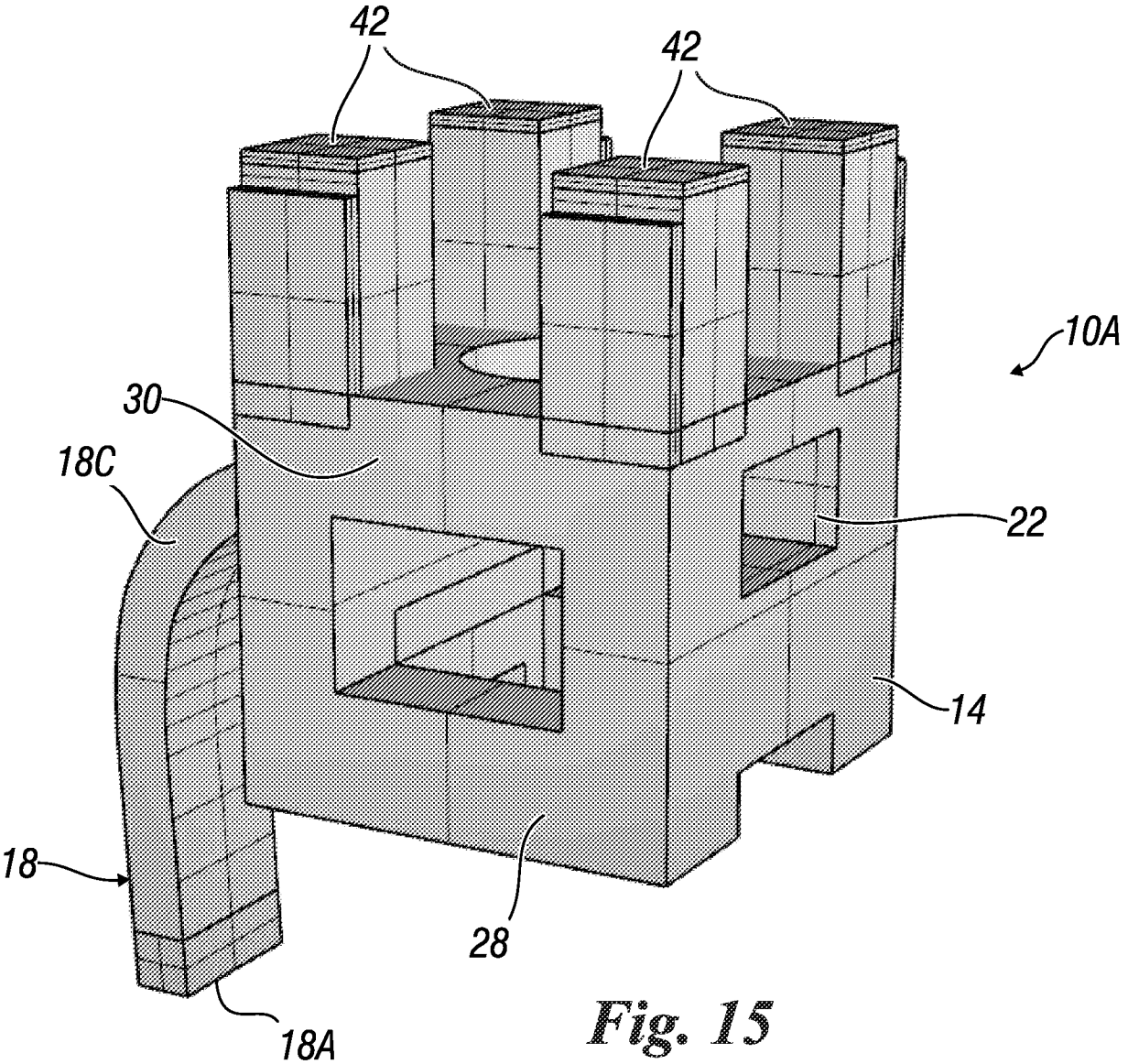
FIGS. 15 and 16 show a second embodiment of the link component illustrated in FIG. 9 in a perspective view and a side view respectively.
Figure 16:
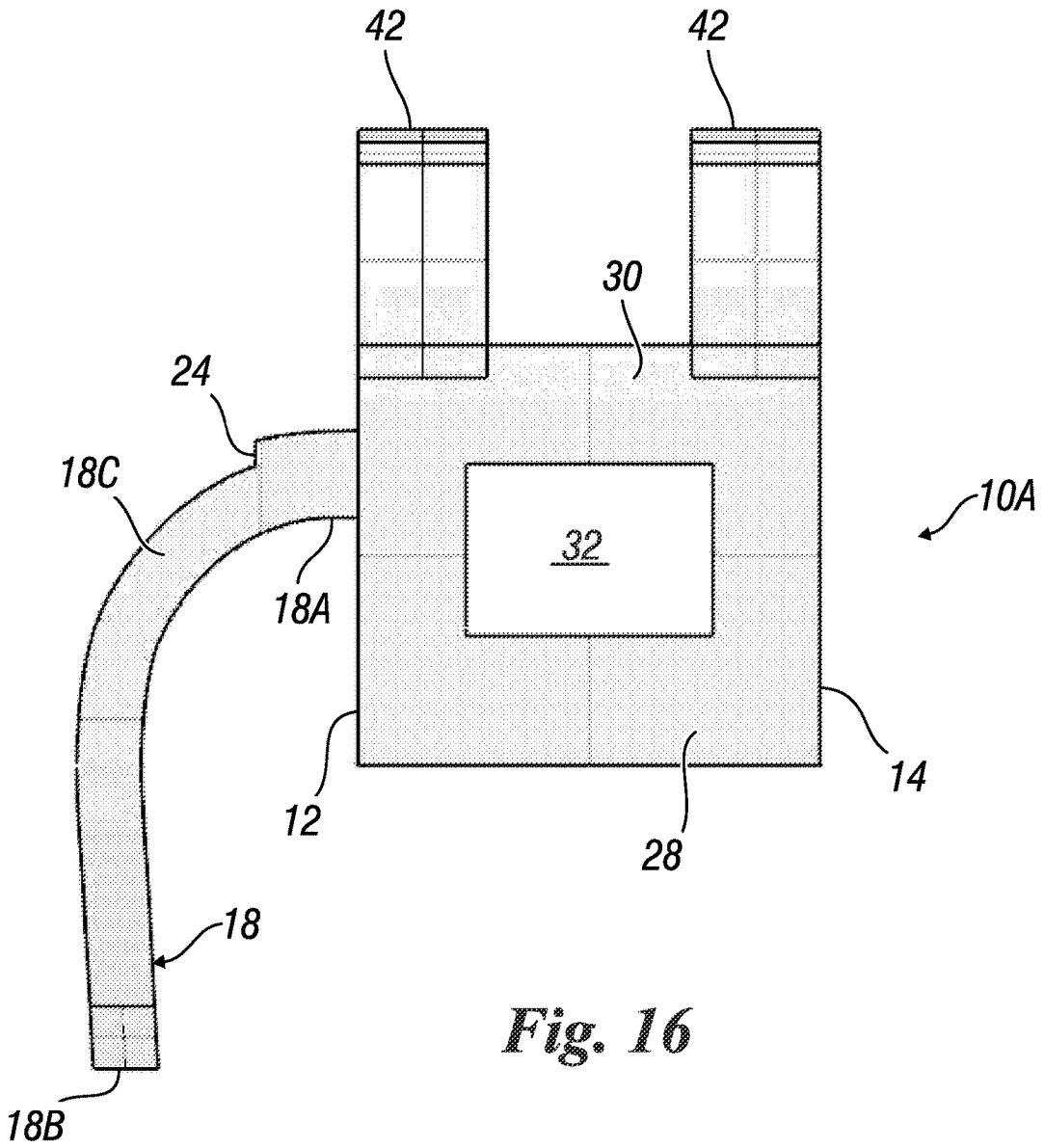

With reference to the figures, a number of preferred embodiments of a link component 10A-10D according to the present invention are shown. The link components 10A-10D are configured for assembling a jewelery item featuring a chain-link structure, preferably but not exclusively comprised of a so-called "tennis" bracelet. Each link component 10A-10D substantially consists of an internally hollow body, comprising a first side surface 12 and a second side surface 14 substantially opposed to and spaced from each other. Preferably, as shown in FIGS. 1-12 and 15-16, the first side surface 12 and the second side surface 14 consist of respective flat and continuous walls. However, there is no preclusion to further embodiments, as it will be better specified below with reference to FIGS. 13 and 14. The first side surface 12 and the second side surface 14 are permanently connected to each other via one or more junction elements 28 and 30, forming one piece together with the first side surface 12 and the second side surface 14.

According to the embodiments illustrated in the figures, the junction elements 28 and 30 form a bottom surface 28 and a top surface 30 of each link component 10A-10D. The bottom surface 28 is that surface which is intended for getting in contact with a user's body, hence it is a normally non-visible surface, whereas the top surface 30 is the visible surface of the jewelery item. Preferably the bottom surface 28 and the top surface 30 of each link component 10A-10D are substantially parallel to each other and orthogonal to the first side surface 12 and to the second side surface 14, so that each link component 10A-10D has a substantially parallelepiped shape. Each link component 10A-10D is also provided with at least one connecting arm 16, 18, which project outwards from the first side surface 12, and at least one through opening 20, 22, obtained on the second, opposed side surface 14. The connecting arm 16, 18 of a given link component 10A is designed to be inserted into a corresponding through opening 20, 22 of an adjacent link component 10B to join the first link component 10A with such adjacent link component 10B.

According to the invention, at least one pin 24, featuring a substantially polyhedral shape and having overall dimensions smaller than the overall dimensions of the connecting arm 16 or 18, is provided in addition to such connecting arm 16 or 18 on a portion of either side surface 12 or 14 of each link component 10A-10D, which preferably is the first side surface 12 on which the connecting arm 16 or 18 is obtained. Accordingly, a corresponding through connecting hole 26 having a shape and dimensions substantially equal to those of the pin 24 is provided on the opposed side surface 14 or 12 of each link component 10A-10D, which preferably is the second side surface 14 on which the through opening 20 is obtained. The pin 24 of a given link component 10A is thus designed to be inserted into a corresponding connecting through hole 26 of an adjacent link component 10B in a shape coupling manner and with a very small clearance. In this way, a relative movement of rotation around the axis A of the pin, between the first link component 10A and the adjacent link component 10B, is prevented, or at least considerably limited, in the assembled configuration of the jewelery item.

In order to prevent a relative movement of rotation of the link components 10A-10D, while retaining ease of linking for jewelery items featuring a so-called "tennis" chain-link structure, the pin 24 of each link 10A-10D is placed above its respective connecting arm 16, 18, as referred to the position of the bottom surface 28. Consequently, the connecting through hole 26 of each link 10A-10D is in turn placed above its respective through opening 20, 22, as referred to the position of the bottom surface 28.

Preferably, the pin 24 has a substantially parallelepiped shape and, consequently, the connecting through hole 26 has a substantially rectangular shape. In order to provide for a shape coupling with a very small clearance, the pin 24 has a width L1 and a height H1 equal to about 95% of the width L2 and of the height H2 respectively of its corresponding connecting through hole 26. In other words, each pin 24 is just a little smaller than its corresponding connecting through hole 26. In this way, the insertion of each pin 24 of a given link component 10A in its corresponding connecting through hole 26 of the adjacent link component 10B is facilitated. In addition, this feature enables a jewelery item as a whole to bend and fit a specific anatomical part of a user, while preventing the individual link components 10A-10D from twisting one with respect to the other.

Preferably the pin 24 having a substantially parallelepiped shape has a length T1, as measured in the direction of its own axis A, which substantially equals the thickness T2 of the second side surface 14. In this way, in an assembled configuration of two link components 10A and 10B adjacent to each other, the pin 24 of a given link component 10A does not project beyond the inner wall of the side surface 14 of the adjacent link component 10B.

Conveniently one or more window opening 32 can be obtained between the first side surface 12, the second side surface 14, the bottom surface 28, and the top surface 30. These window openings 32 are configured to assist the linking and welding operations between the various adjacent link components 10A-10D. As a matter of fact, it is possible for an operator to perform a variety of operations, such as for example the welding operations described below more in details, by introducing the specific tools within these window openings 32.

Two or more tips 42, between which at least one decorative stone P, such as for example a precious or semi-precious stone, is intended to be secured (FIGS. 13 and 14), can be provided on the top surface 30 of one or more link components 10A-10D of the jewelery item. Alternatively, the top surface 30 of one or more link components 10A-10D can be worked in an intrinsically known manner.

According to the first embodiment of the link components 10A-10D illustrated in FIGS. 1 to 5, the connecting arm 16 of each link component 10A-10D has a substantially parallelepiped shape and extends along a second axis B which is substantially parallel to the axis A of the pin 24, as well as orthogonal to the first side surface 12 which such connecting arm 16 projects from. Accordingly, each connecting arm 16 is provided with a through hole 34 oriented along a third axis which is substantially perpendicular to the second axis B. Each through hole 34 is designed for introducing a fastening plug 36.

The side surface 14 of each link component 10A-10D, on which the connecting through hole 26 is obtained, is conversely provided with an end tooth 38 facing the inner wall of such side surface 14 or, in other words, the opposed side surface 12. The end tooth 38 of a given link component 10A-10D is designed for operating as an end-of-stroke for the fastening plug 36 whenever it is inserted into the through hole 34 of the connecting arm 16 of an adjacent link component 10A-10D.

Figure 6:
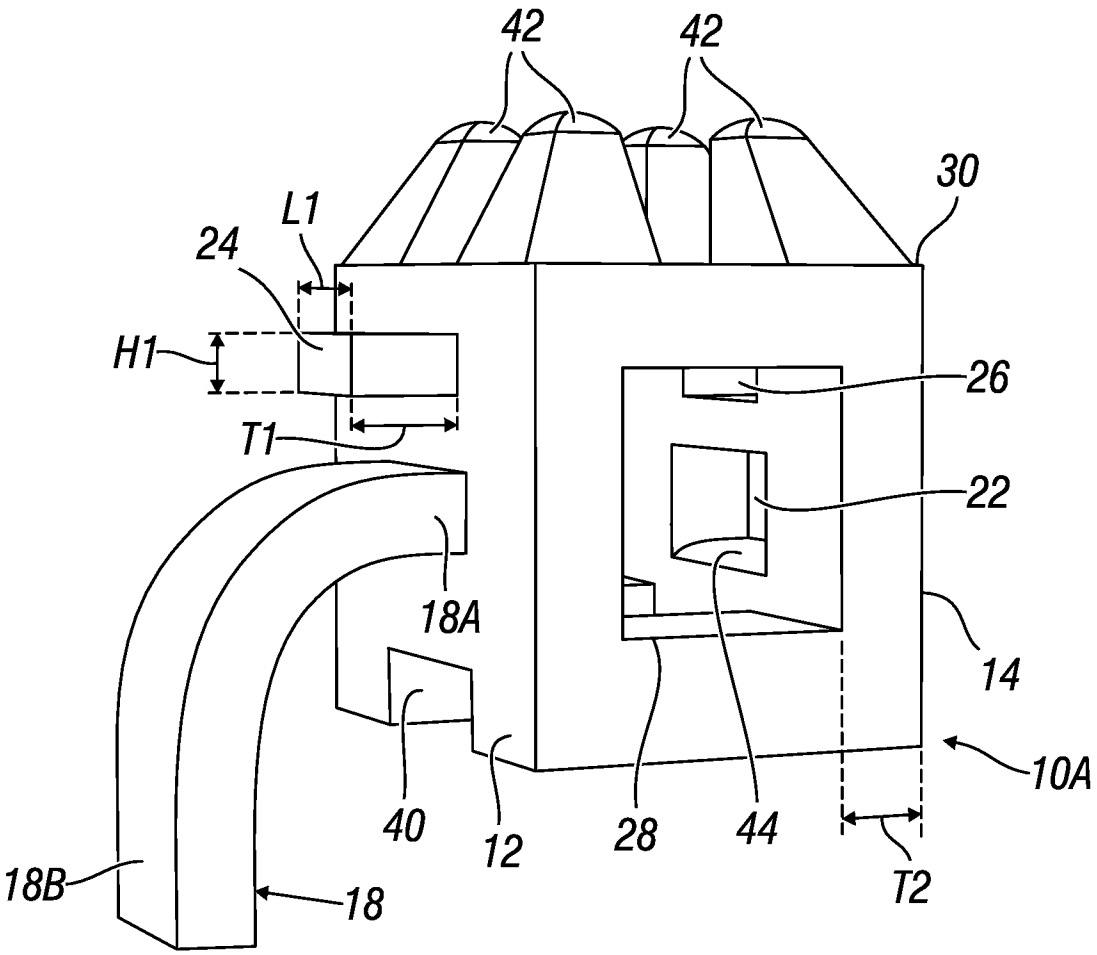
FIG. 6 is a perspective view of a second embodiment of a link component according to the present invention.
Figure 7:
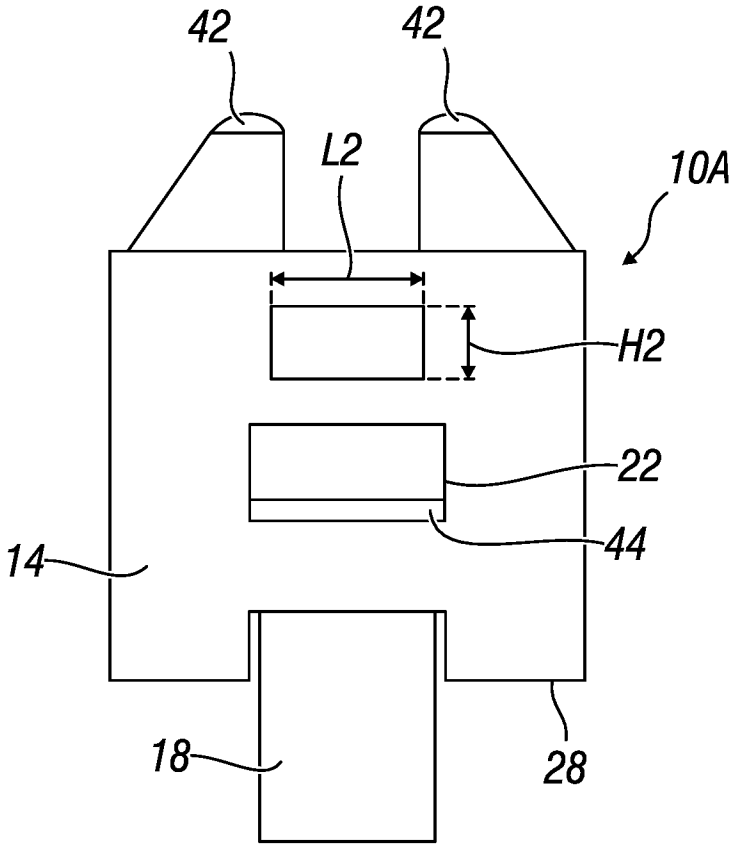
FIG. 7 is a side view of the link component illustrated in FIG. 6.
Figure 8:
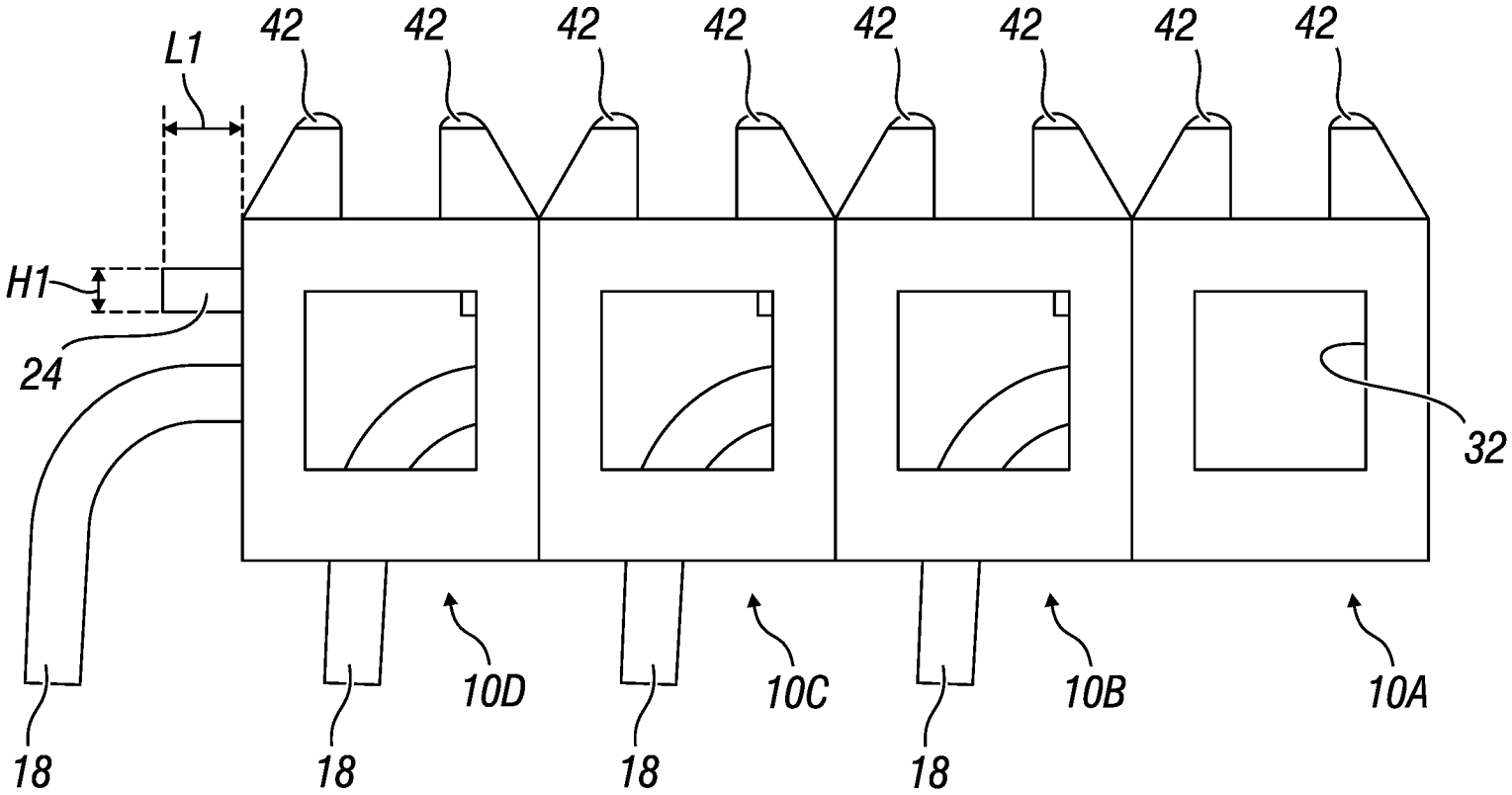
FIG. 8 is a side view of some link components as that illustrated in FIG. 6, shown in a linking step.
Figure 9:
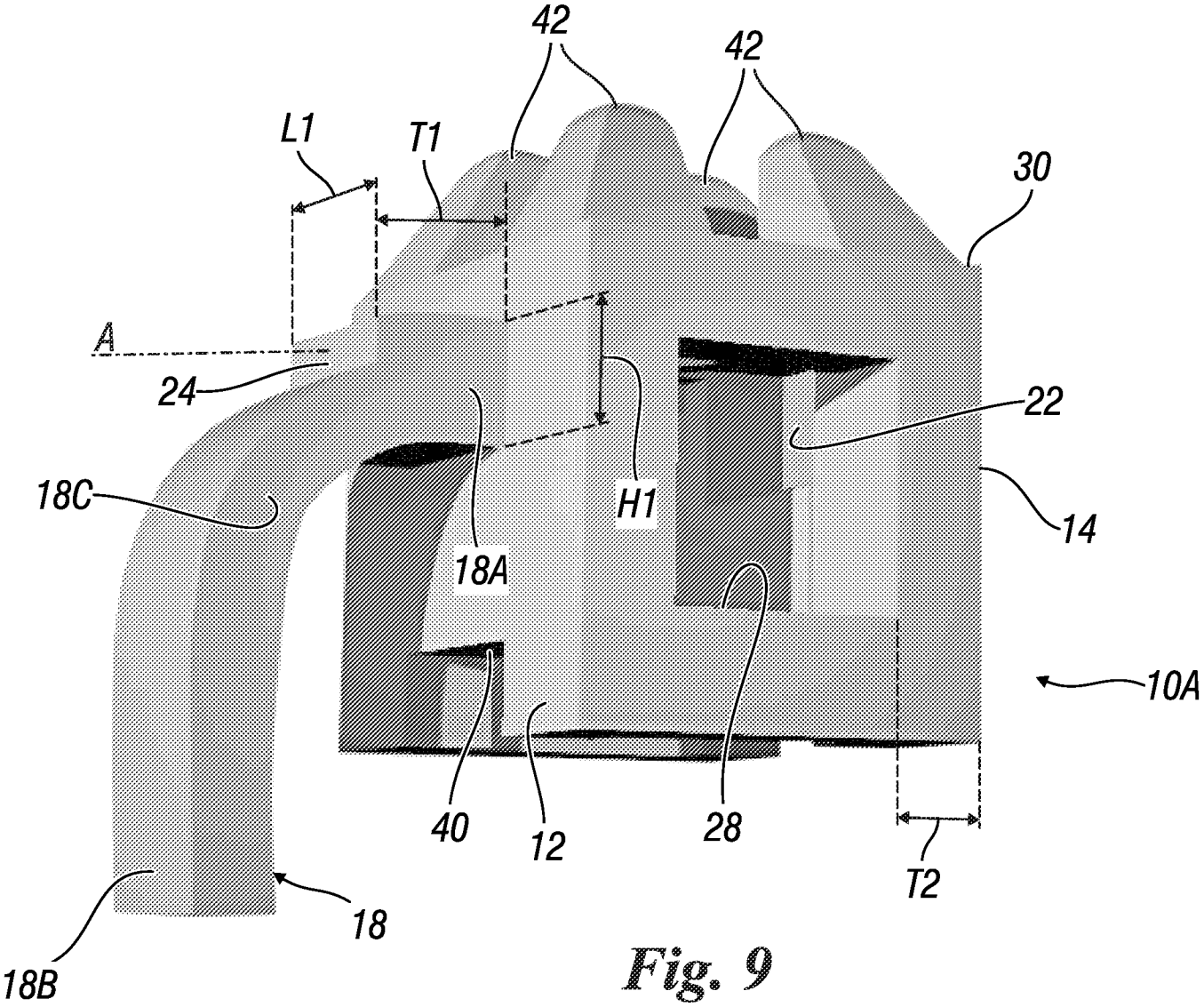
FIG. 9 is a perspective view of a third embodiment of a link component according to the present invention.
Figure 10:
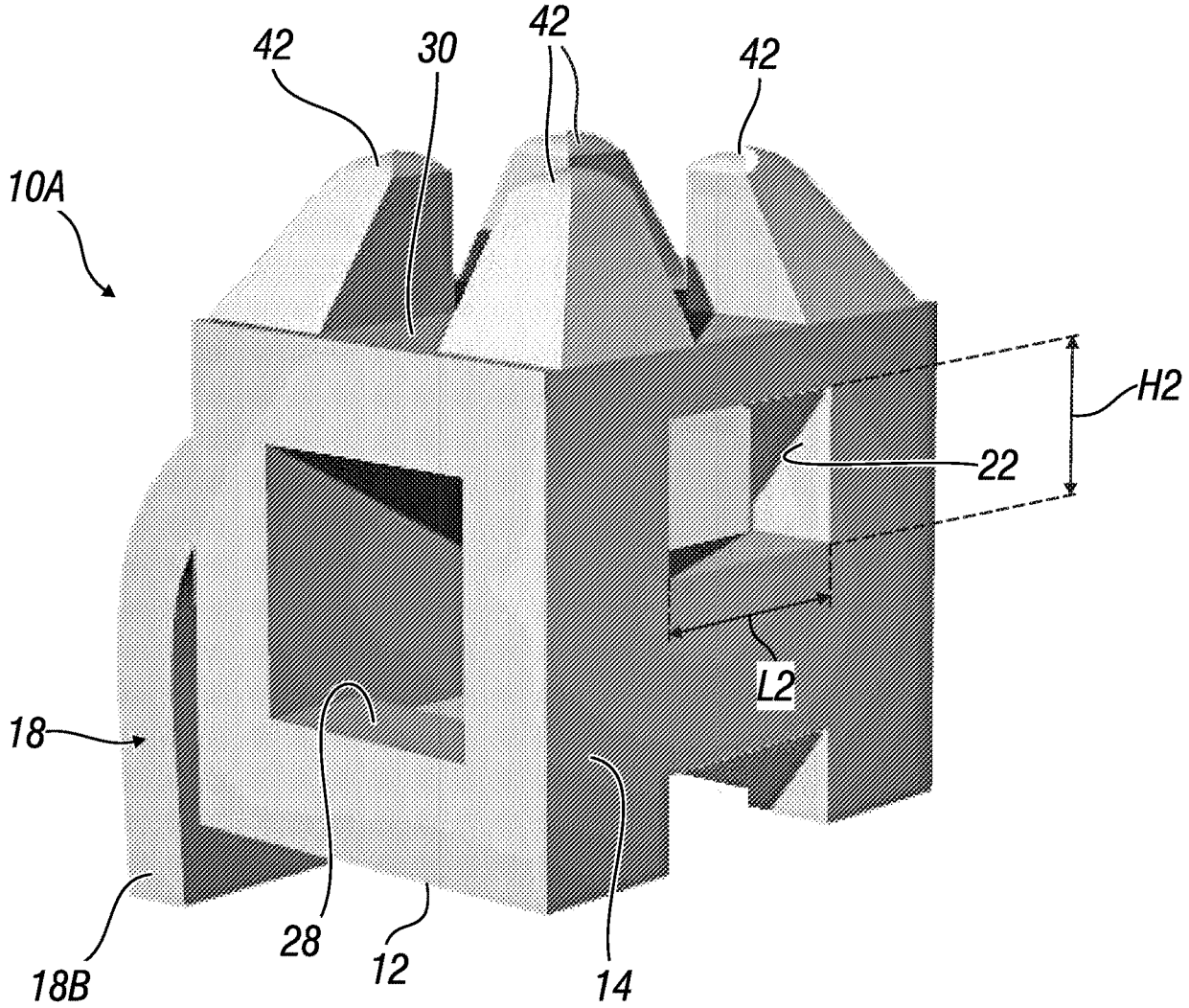
FIG. 10 is another perspective view of the link component illustrated in FIG. 9.
Figure 11:
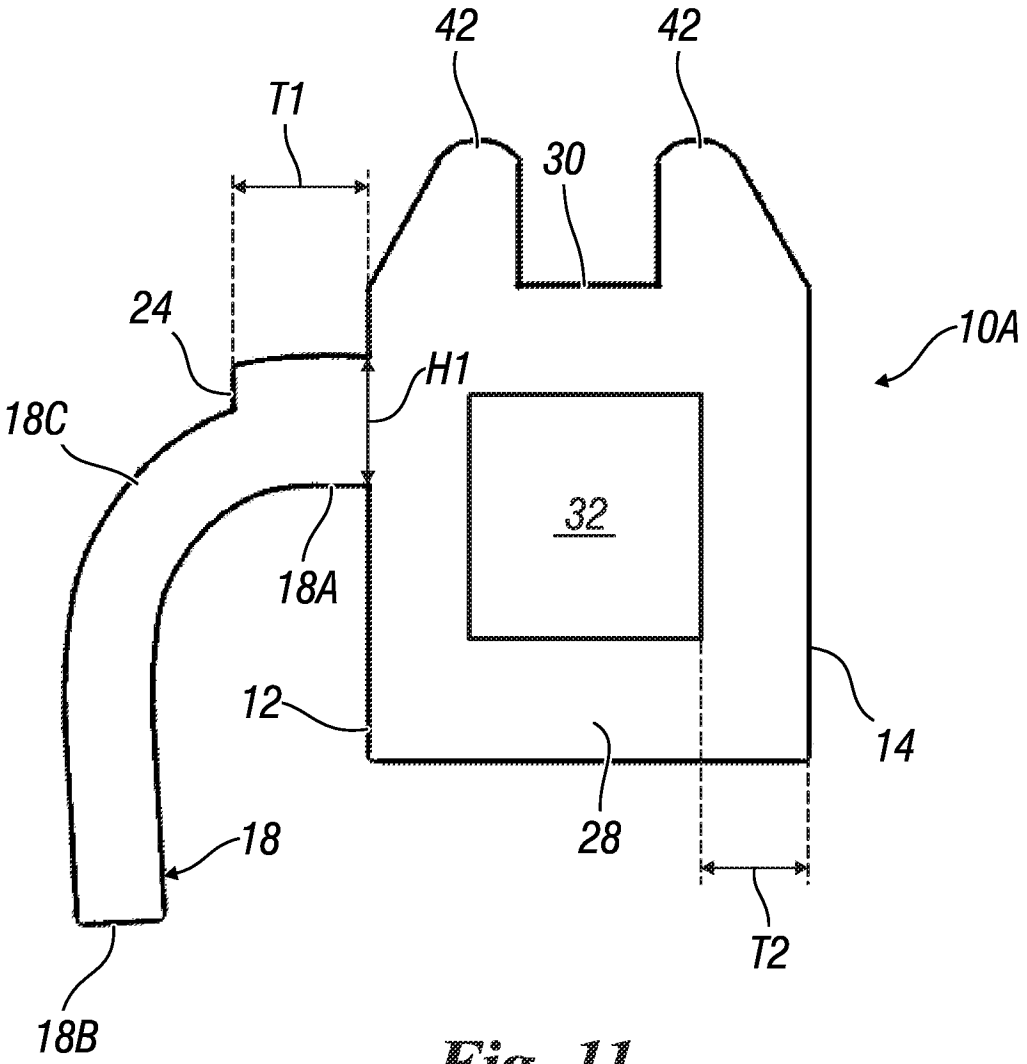
FIG. 11 is a side view of the link component illustrated in FIG. 9.
Figure 12:
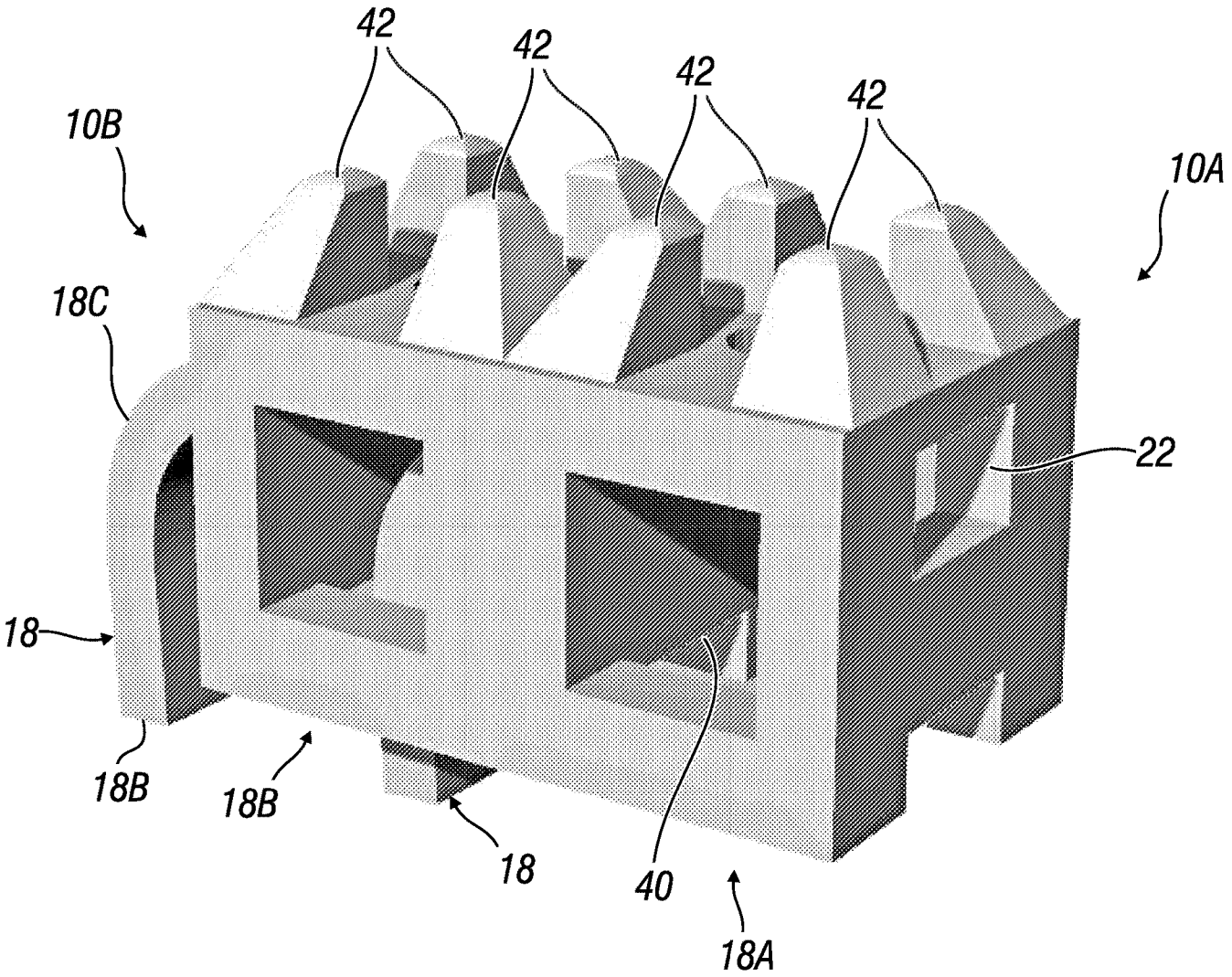
FIG. 12 is a perspective view of some link components as that illustrated in FIG. 9, shown in a linking step.

According to a second embodiment of the link components 10A-10D illustrated in FIGS. 6 to 8, the connecting arm 18 of each link component 10A-10D is substantially L-shaped and comprises a first portion 18A, which projects from the first side surface 12 and is substantially orthogonal to such first side surface 12, and a second portion 18B, which extends from the first portion 18A and is substantially parallel to the first side surface 12. According to this embodiment, each link component 10A-10D comprises a bottom surface 28 provided with at least one notch 40 designed to accommodate the free end of the second portion 18B of its own L-shaped connecting arm 18 in an assembled configuration of a jewelery item.

According to a third embodiment of the link components 10A-10B illustrated in FIGS. 9 to 16, the connecting arm 18 of each link component 10A-10B is also substantially L-shaped and comprises a first portion 18A, which projects from the first side surface 12 and is substantially orthogonal to such first side surface 12, and a second portion 18B, which extends from the first portion 18A and is substantially parallel to the first side surface 12. Preferably, a rounded portion 18B is interposed between the first portion 18A and the second portion 18B of each connecting arm 18, so as to assist the insertion movement of the connecting arm 18 of a given link component 10A in its corresponding through opening 22 of an adjacent link component 10B.

So, each link component 10A-10B comprises a bottom surface 28 provided with at least one notch 40 designed to accommodate the free end of the second portion 18B of its own L-shaped connecting arm 18 in an assembled configuration of a jewelery item.

According to this third embodiment of the link components 10A-10B illustrated in FIGS. 9 to 16, at least one pin 24 having a substantially polyhedral shape, integrally formed as a single piece with the first portion 18A of such connecting arm 18, is provided on a portion of the first side surface 12 on which the connecting arm 18 is obtained. The pin 24 of a given link component 10A is thus designed to be inserted into the through opening 22 of an adjacent link component 10B, in a shape coupling manner and with a very small clearance, where such through opening 22 also operates as a connecting through hole for the pin 24 itself. In this way, a relative movement of rotation around the axis A of the pin 24, between the first link component 10A and the adjacent link component 10B is prevented, or at least considerably limited, in the assembled configuration of a jewelery item.

In order to prevent a relative movement of rotation of the link components 10A-10B, while retaining ease of linking for jewelery items featuring a so-called "tennis" chain-link structure, the pin 24 of each link 10A-10B is in this case too placed above the first portion 18A of such respective connecting arm 18, as referred to the position of the bottom surface 28.

Preferably, the pin 24 and the first portion 18A of the connecting arm 18, which are integrally formed as a single piece, have a substantially parallelepiped-shaped cross section. Consequently, the through opening 22, which also operates as a connecting through hole for the pin 24, has a substantially rectangular shape. To make it possible a shape coupling with a very small clearance, the single piece formed of the pin 24 and the first portion 18A of the connecting arm 18 has a width L1 and a height H1 equal to about 95% of the width L2 and of the height H2 respectively of its corresponding through opening 22. In other words, each single-piece body formed of the pin 24 and the first portion 18A of the connecting arm 18 of a given link component 10A is just slightly smaller than its corresponding through opening 22 of the adjacent link component 10B. In this way, the insertion of the connecting arm 18 and its respective pin 24 of a given link component 10A in its corresponding through opening 22 of the adjacent link component 10B is facilitated. In addition, this feature allows for a jewelery item as a whole to bend and fit a specific anatomical part of a user, while preventing the various link components 10A-10B from twisting one with respect to the other.

Preferably the pin 24 having a substantially parallelepiped shape has a length T1, as measured in the direction of its own axis A, which substantially equals the thickness T2 of the second side surface 14. In this way, in an assembled configuration of two link components 10A and 10B adjacent to each other, the pin 24 of a given link component 10A does not project beyond the inner wall of the side surface 14 of the adjacent link component 10B.

Conveniently, in the third embodiment of the link components 10A-10B, one or more window openings 32 can be provided between the first side surface 12, the second side surface 14, the bottom surface 28, and the top surface 30. These window openings 32 are configured to assist the linking and welding operations between the various adjacent link components 10A-10B. As a matter of fact, it is possible for an operator to perform a variety of operations, by introducing the specific tools within these window openings 32. In the third embodiment of the link component 10A-10B too, two or more tips 42, between which at least one decorative stone P, such as for example a precious or semi-precious stone is intended to be secured (FIGS. 13 and 14), can be provided on the top surface 30. Alternatively, the top surface 30 of one or more link components 10A-10B can be worked in an intrinsically known manner.

As shown in the embodiments illustrated in FIGS. 13 to 16, the shape of the link components 10A-10B can vary as a function of the actual requirements. For example, the cross section of the junction elements 28 and 30 might have a quadrangular shape (FIGS. 15 and 16), a substantially circular shape (FIGS. 13 and 14), or even other types of shape. Likewise, the tips 42 might also have a substantially pyramidal shape (FIGS. 9 to 12), cylindrical shape (FIGS. 13 and 14), parallelepiped shape (FIGS. 15 and 16) or even other types of shape. In any case, the shape of the connecting arm 18, the pin 24, and the through opening 22 remain substantially identical, so as to guarantee an optimum assembling of a jewelery item through the following method.

So, the method for assembling a jewelery item by using the link components 10A-10D described so far comprises the following operating steps. Starting from a first link component 10A, the connecting arm 16 or 18 of such first link component 10A is first inserted into its corresponding through opening 20 or 22 of a second adjacent link component 10B, so as to move the first side surface 12 of the first link component 10A closer to the second side surface 14 of the second adjacent link component 10B.

Then, while the first side surface 12 of the first link component 10A is moved closer to the second side surface 14 of the second adjacent link component 10B, the pin 24 of one of these link components, which is the first link component 10A in the examples illustrated above, is inserted into its corresponding connecting through hole 26 of the adjacent link component 10B. In this way, the first side surface 12 of the first link component 10A is joined to the second side surface 14 of the second adjacent link component 10B, while preventing any relative movement of rotation around the axis A of the pin 24, between the just linked first link component 10A and the second link component 10B.

At this point, the two just linked link components 10A and 10B are secured to each other. This operation is performed by welding the connecting arm 16 or 18 of the first link component 10A to a determined surface of the second adjacent link component 10B, so as to only allow an angular movement of the two link components 10A and 10B with respect to the junction plane of their respective first side surface 12 and second side surface 14.

Figure 1:
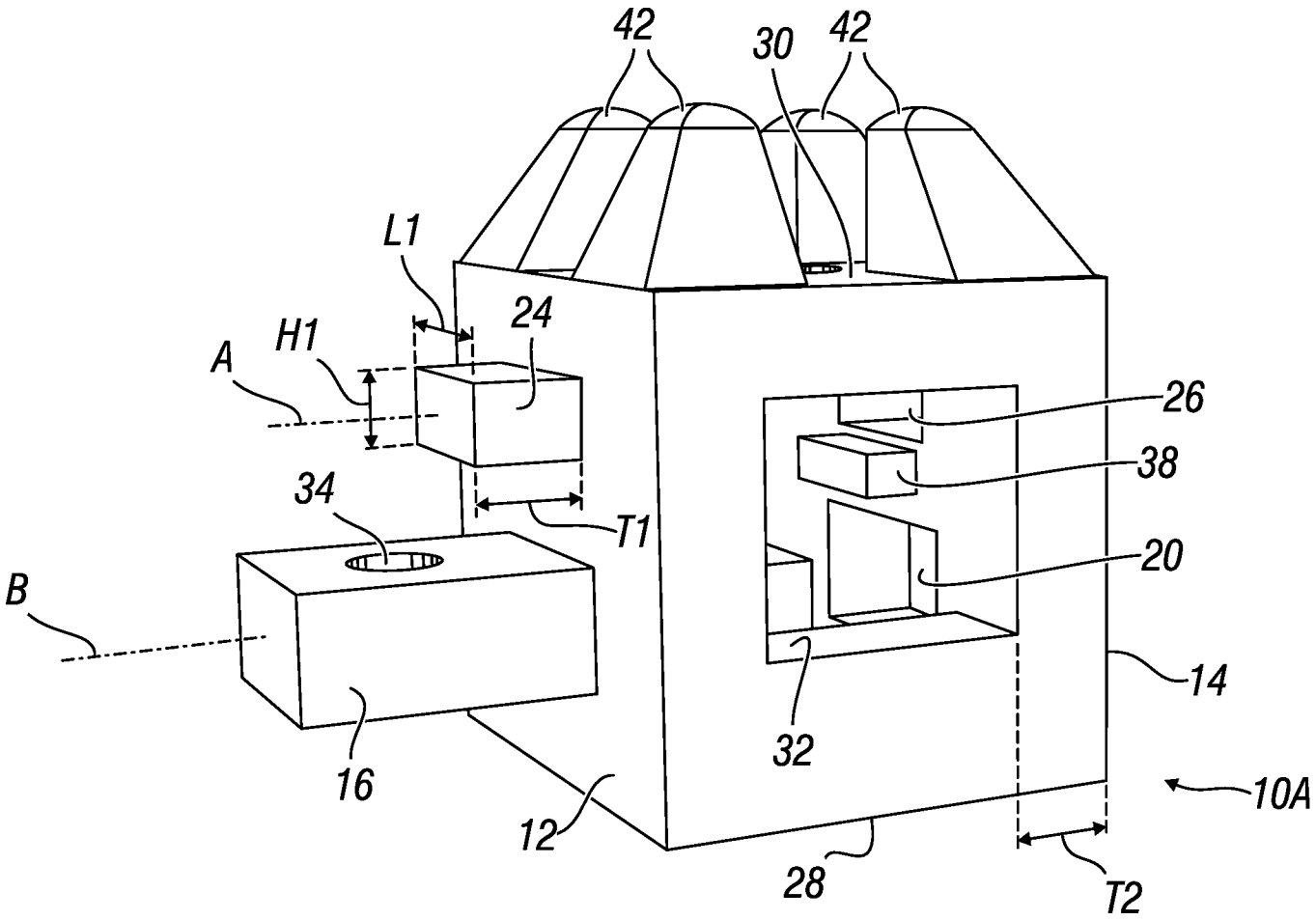
FIG. 1 is a perspective view of a first embodiment of a link component according to the present invention.
Figure 2:
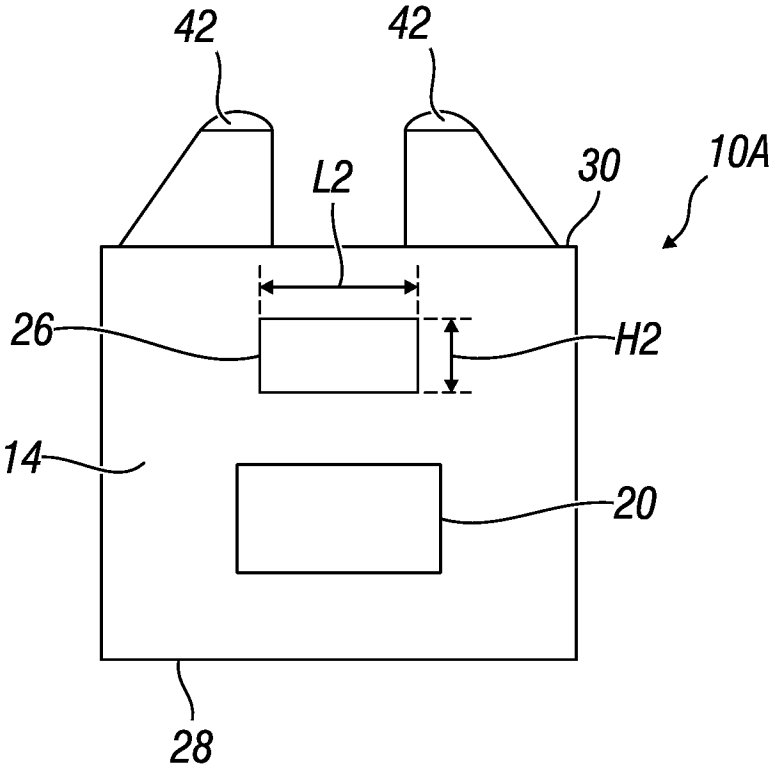
FIG. 2 is a side view of the link component illustrated in FIG. 1.
Figure 3:
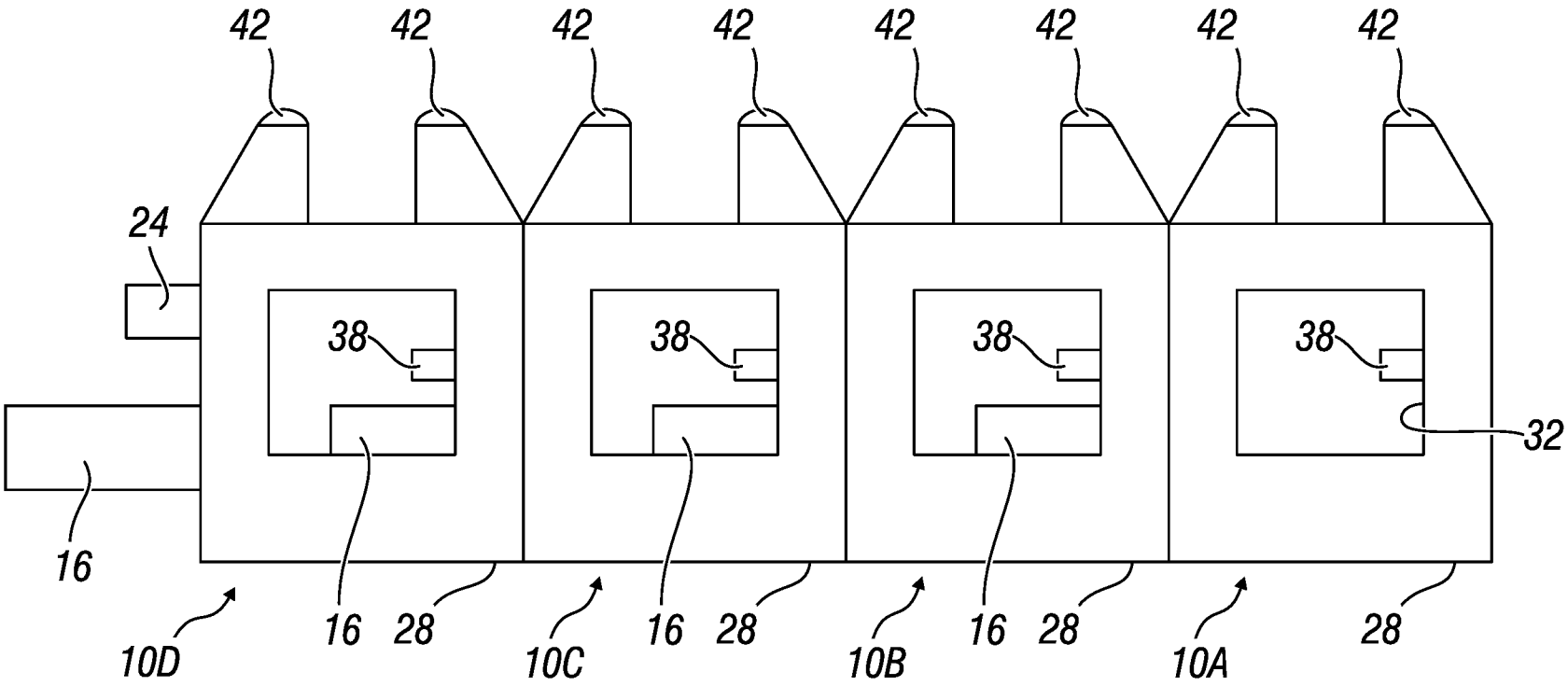
FIG. 3 is a side view of some link components illustrated in FIG. 1, shown in a linking step.
Figure 4:
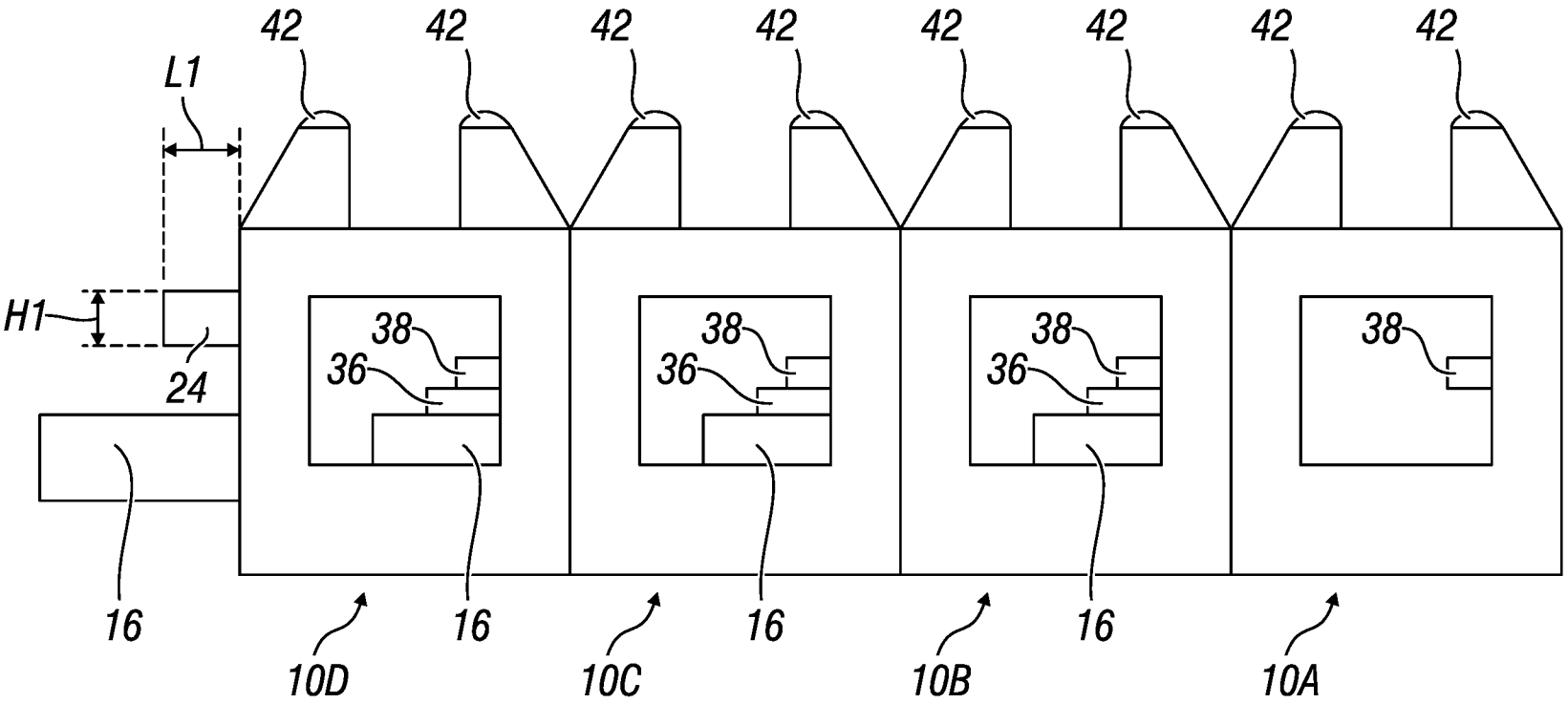
FIG. 4 is a side view of some link components illustrated in FIG. 1, shown in a further linking step.
Figure 5:
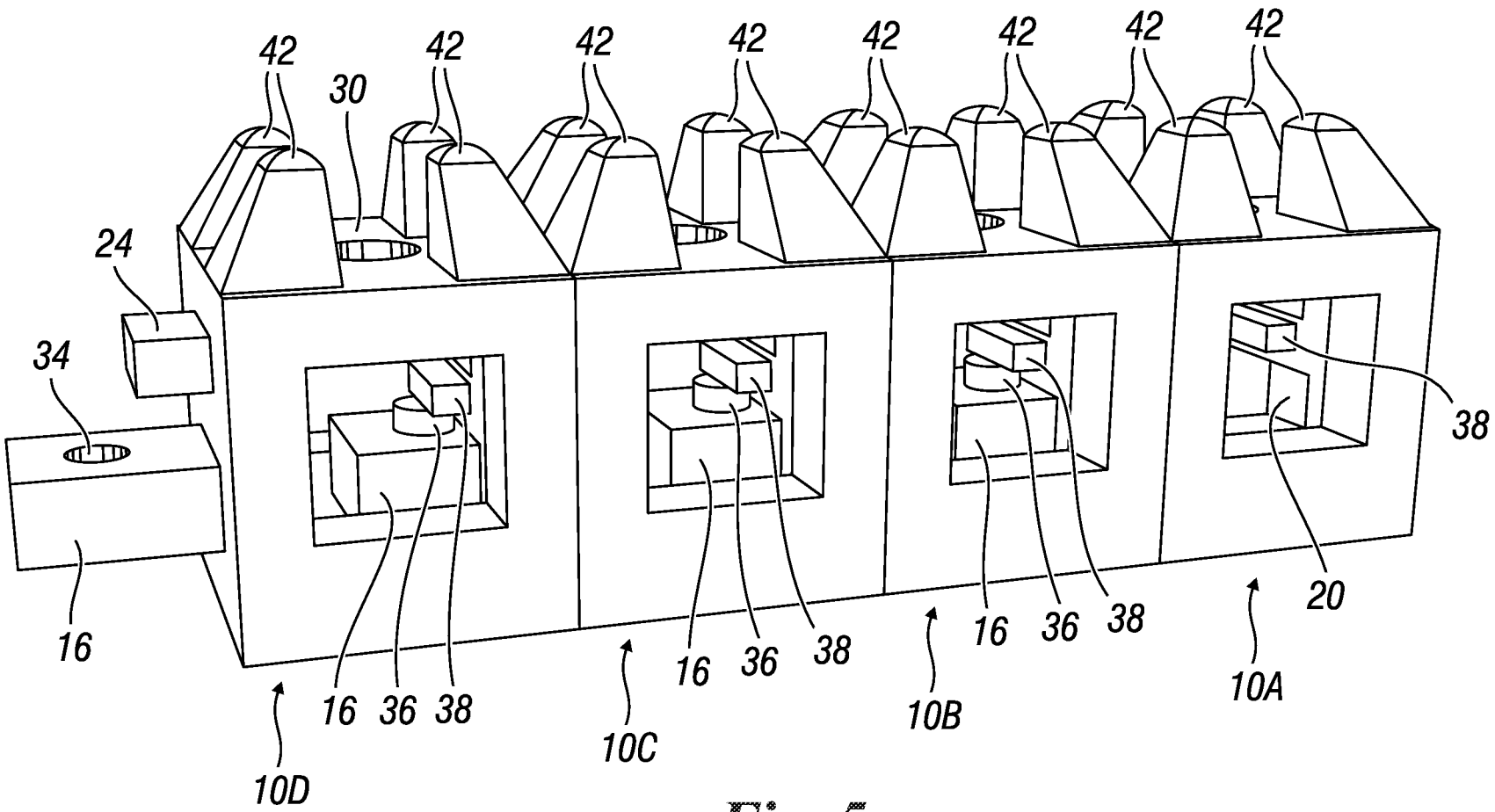
FIG. 5 is a perspective view of some link components as that illustrated in FIG. 1, shown in the linking step illustrated in FIG. 4.

In the embodiment illustrated in FIGS. 1 to 5, wherein the connecting arm 16 has a substantially parallelepiped shape and extends parallel to the pin 24, the step of moving the first side surface 12 of the first link component 10A closer to the second side surface 14 of the second link component 10B is performed along the parallel axes A and B of such pin 24 and such connecting arm 16 respectively. Once the two link components 10A and 10B of the type shown in FIG. 1 are linked, the following further steps are performed in order to secure them:

inserting a fastening plug 36 into the through hole 34 obtained on the connecting arm 16 of the first link component 10A;

abutting the fastening plug 36 against the end tooth 38 obtained on the second side surface 14 of the second link component 10B; and welding the fastening plug 36 within its respective through hole 34.

In the embodiment illustrated in FIGS. 6 to 16, wherein the connecting arm 18 is substantially L-shaped, the step of moving the first side surface 12 of the first link component 10A closer to the second side surface 14 of the second link component 10B is performed by sliding firstly the second portion 18B of the connecting L-shaped arm 18, then the first portion 18A of such connecting L-shaped arm 18, within the connecting through hole 26 of the adjacent link component 10B. The through opening 22 of each link component 10A-10D might be provided with a widened central portion 44 to assist this operation.

Once the two link components 10A and 10B of the type shown in FIGS. 6 to 16 are linked, the following further steps are performed to secure them:

folding the second portion 18B of the connecting arm 18 of the first link component 10A towards the bottom surface 28 of the first link component 10A itself;

introducing the free end of the second portion 18B of the connecting arm 18 into a corresponding notch 40 obtained on the bottom surface 28; and welding such free end within the notch 40.

The foregoing demonstrates that a jewelery item featuring a chain-link structure according to the present invention achieves the previously highlighted objects.

A thus conceived jewelery item having a chain-link structure according to the present invention is in any case susceptible of numerous modifications and variants, all of them falling within one and the same inventive concept; also, all details are replaceable by technically equivalent elements. In practice, the material used, as well as shapes and dimensions, might be whatsoever depending on the technical requirements. The scope of protection of the invention is therefore that set forth by the following claims.

The invention claimed is:

1. A plurality of link components (10A-10D) for assembling a jewelery item featuring a chain-link structure, each link component (10A-10D) including an internally hollow body comprising:

a first side surface (12) and a second side surface (14) substantially opposed to and spaced from each other;

a plurality of junction elements (28, 30) for connecting said first side surface (12) to said second side surface (14), said plurality of junction elements (28, 30) being integrally formed with said first side surface (12) and said second side surface (14)), said plurality of junction elements (28, 30) comprising a bottom surface (28) and a top surface (30), said bottom surface (28) and said top surface (30) being substantially parallel to each other and orthogonal to said first side surface (12) and to said second side surface (14), so that each link component (10A-10D) has a substantially parallelepiped shape;

at least one connecting arm (16; 18) which projects outwards from said first side surface (12); and at least one through opening (20; 22) on said second side surface (14), wherein said connecting arm (16; 18) of a first link component (10A) of the plurality of link components is configured to be inserted into a corresponding through opening (20; 22) of a second adjacent link component (10B) of the plurality of link components to connect said first link component (10A) to said second link component (10B), wherein at least one pin (24) having a substantially polyhedral shape and having overall dimensions smaller than the overall dimensions of said at least one connecting arm (16; 18) is provided on a portion of said first side surface (12) in addition to said at least one connecting arm (16; 18), and wherein a corresponding connecting through hole (26) having shape and dimensions substantially equal to those of said at least one pin (24) is provided on a portion of the second side surface opposed to that including said at least one pin (24), the pin (24) of the first link component (10A) being configured to be inserted into a corresponding connecting through hole (26) of the second adjacent link component (10B) in a shape coupling manner, so as to prevent a relative movement of rotation around an axis (A) of the pin, between said first link component (10A) and said second link component (10B) in an assembled configuration of a jewelery item, wherein said pin (24) is provided on the first side surface (12), whereas said connecting through hole (26) is provided on the second side surface (14), and wherein said pin (24) is placed above the connecting arm (16; 18) and said connecting through hole (26) is placed above the through opening (20; 22).

2. The link component (10A-10D) according to claim 1, characterized in that said pin (24) has a substantially parallelepiped shape and said connecting through hole (26) has a substantially rectangular shape, said pin (24) having a width (L1) and a height (H1) equal to about 95% of the width (L2) and of the height (H2) respectively of its corresponding connecting through hole (26).

3. The link component (10A-10D) according to claim 1, characterized in that said connecting arm (16) has a substantially parallelepiped shape and extends along a second axis (B) substantially parallel to said axis (A) of the pin (24) and orthogonal to said first side surface (12), wherein said connecting arm (16) is provided with a through hole (34), oriented along a third axis which is substantially perpendicular to said second axis (B), and wherein said through hole (34) is designed to receive a fastening plug (36).

4. The link component (10A-10D) according to claim 3, characterized in that said side surface (14) on which said connecting through hole (26) is obtained is also provided with an end tooth (38), facing the opposed side surface (12)

and designed to operate as an end-of-stroke for said fastening plug (36) whenever it is inserted into the through hole (34) of the connecting arm (16) of an adjacent link component (10A-10D).

5. The link component (10A-10D) according to claim 3, characterized in that it comprises one or more window openings (32) interposed between said bottom surface (28), said top surface (30), and said first side surface (12) and second side surface (14).

6. The link component (10A-10D) according to claim 1, characterized in that said connecting arm (18) is substantially L-shaped and comprises a first portion (18A), which projects from said first side surface (12) and is substantially orthogonal to said first side surface (12), and a second portion (18B), which extends from said first portion (18A) and is substantially parallel to said first side surface (12).

7. The link component (10A-10D) according to claim 6, characterized in that said at least one pin (24) is provided on a portion of the first side surface (12) on which said connecting arm (18) is obtained, and in that said at least one pin (24) is integrally formed with the first portion (18A) of said connecting arm (18).

8. The link component (10A-10D) according to claim 7, characterized in that said pin (24) and said first portion (18A) of the connecting arm (18) are integrally formed as a single piece and their cross sections are substantially parallelepiped-shaped, whereas said through opening (22) also operates as a connecting through hole for said pin (24) and has a substantially rectangular shape.

9. The link component (10A-10D) according to claim 8, characterized in that said single piece formed of the pin (24) and the first portion (18A) of the connecting arm (18) has a width (L1) and a height (H1) equal to about 95% of the width (L2) and of the height (H2) respectively of its corresponding through opening (22).

10. The link component (10A-10D) according to claim 8, characterized in that said pin (24) is placed above the first portion (18A) of said connecting arm (18), as referred to the position of the bottom surface (28).

11. The link component (10A-10D) according to claim 8, characterized in that a rounded portion (18C) is interposed between the first portion (18A) and the second portion (18B) of said connecting arm (18), so as to assist the insertion movement of said connecting arm (18) of a first link component (10A) into its corresponding through opening (22) of a second adjacent link component (10B).

12. The link component (10A-10D) according to claim 8, characterized in that it comprises a bottom surface (28) provided with at least one notch (40) designed to accommodate the free end of the second portion (18B) of said L-shaped connecting arm (18) in an assembled configuration of a jewelery item.

13. The link component (10A-10D) according to claim 1, characterized in that said top surface (30) is provided with two or more tips (42) between which at least one decorative stone is intended to be secured.

14. A jewelery item featuring a chain-link structure, characterized in that it comprises a plurality of link components (10A-10D) according to claim 1.

15. A method for assembling a jewelery item according to claim 14, comprising the following steps:

providing a first link component (10A) and at least one second link component (10B);

inserting the connecting arm (16; 18) of said first link component (10A) into a corresponding through opening (20; 22) of said second link component (10B), so as to move the first side surface (12) of said first link component (10A) closer to the second side surface (14) of said second link component (10B);

inserting the pin (24) of one of said first link component (10A) and said second link component (10B) into a corresponding connecting through hole (26) of the second link component (10B), so as to connect the first side surface (12) of said first link component (10A) to the second side surface (14) of said second link component (10B) and prevent a relative movement of rotation, around an axis (A) of the pin (24), between said first link component (10A) and said second link component (10B);

fastening said first link component (10A) and said second link component (10B) through a welding operation performed on the connecting arm (16; 18) of said first link component (10A) and on a certain surface of said second link component (10B), so as to only allow an angular movement of said first link component (10A) and of said second link component (10B) with respect to a junction plane of the first side surface (12) of said first link component (10A) and the second side surface (14) of said second link component (10B).

16. The method according to claim 15, wherein said connecting arm (16) has a substantially parallelepiped shape and extends along a second axis (B) substantially parallel to said axis (A) of the pin (24) and orthogonal to said first side surface (12), wherein moving the first side surface (12) of said first link component (10A) closer to the second side surface (14) of said second link component (10B) is performed along said axis (A) of the pin (24) and said second axis (B), and wherein securing said first link component (10A) and said second link component (10B) comprises the further steps of:

inserting a fastening plug (36) into a through hole (34) obtained on the connecting arm (16) of said first link component (10A), said through hole (34) being oriented along a third axis which is substantially perpendicular to said second axis (B);

bringing said fastening plug (36) in abutment against an end tooth (38) obtained on the second side surface (14) of said second link component (10B); and welding said fastening plug (36) inside said through hole (34).

17. The method according to claim 15, wherein said connecting arm (18) is substantially L-shaped and comprises a first portion (18A), which projects from said first side surface (12) and is substantially orthogonal to said first side surface (12), and a second portion (18B), which extends from said first portion (18A) and is substantially parallel to said first side surface (12), wherein moving the first side surface (12) of said first link component (10A) closer to the second side surface (14) of said second link component (10B) is performed by sliding firstly said second portion (18B) of the connecting arm (18), then said first portion (18A) of the connecting arm (18), within the connecting through hole (26) of the second link component (10B), and wherein the step of fastening said first link component (10A) and said second link component (10B) comprises the following further steps:

folding the second portion (18B) of the connecting arm (18) of said first link component (10A) towards a bottom surface (28) of said first link component (10A);

introducing a free end of the second portion (18B) of said connecting arm (18) into a corresponding notch (40) obtained on said bottom surface (28); and welding said free end inside said notch (40).

* * * * *